US005582433A

United States Patent [19]

Sisson

[11] Patent Number: 5,582,433

[45] Date of Patent: Dec. 10, 1996

[54] GARAGE SALE PRICING LABELS

[76] Inventor: Lorna W. Sisson, 518 Kalamazoo St., Otsego, Mich. 49078

[21] Appl. No.: 79,624

[22] Filed: Jun. 18, 1993

[51] Int. Cl.[6] ..... G09F 3/00

[52] U.S. Cl. ..... 283/81; 283/101; 283/105; 283/114

[58] Field of Search ..... 283/81, 105, 100, 283/101, 114, 83; 206/460, 821, 397, 459.5, 408, 411; 40/299

[56] References Cited

U.S. PATENT DOCUMENTS

| | | | |
|---|---|---|---|
| 720,287 | 2/1903 | Schmidt | 206/408 |
| 1,258,081 | 3/1918 | Albree | 283/105 X |
| 1,439,400 | 12/1922 | Broz | 283/105 |
| 1,775,225 | 9/1930 | Valentine | 206/397 |
| 2,346,219 | 4/1944 | Johnson | 283/101 X |
| 2,381,605 | 8/1945 | Leander | 206/460 X |
| 2,679,928 | 6/1954 | Bishop, Jr. et al. | 206/460 X |
| 2,681,732 | 6/1954 | Brady, Jr. | 206/460 X |
| 2,748,931 | 6/1956 | Taylor | 206/408 X |
| 2,836,290 | 5/1958 | Braun | 206/460 X |
| 3,090,271 | 5/1963 | Castelli | 206/408 X |
| 3,226,862 | 1/1966 | Gabruk | 283/81 X |
| 3,420,364 | 1/1969 | Kennedy, Jr. | 206/460 |
| 3,467,250 | 9/1969 | D'Elia et al. | 206/411 X |
| 4,438,950 | 3/1984 | Hamisch, Jr. | 283/81 X |
| 4,747,619 | 5/1988 | Sager | 283/81 X |
| 5,090,565 | 2/1992 | Wang | 206/411 |
| 5,139,847 | 8/1992 | Breen | 283/81 X |
| 5,222,766 | 6/1993 | Instance | 283/81 |

FOREIGN PATENT DOCUMENTS

| | | | |
|---|---|---|---|
| 182249 | 2/1918 | Canada | 283/81 |
| 476291 | 8/1951 | Canada | 206/411 |
| 8707580 | 12/1987 | WIPO | 283/81 |

OTHER PUBLICATIONS

Catalogue 1989, Miller's Office Product pp. 706, 756–763, 774–781.

*Primary Examiner*—Frances Han
*Attorney, Agent, or Firm*—Waters & Morse, P.C.

[57] ABSTRACT

Garage sale pricing labels and method comprise a plurality of sets of color coded pricing label strips, each set being color coded to distinguish products of different sellers and each set including separate strips of labels containing different preprinted prices for each strip and one strip containing no price. The labels contain non-adhesive tabs for easy application and removal. The tabs can be adhesive portions covered with unremoved release paper or can be portions not covered by adhesive. The adhesive and labels are specially selected to adhere to a wide range of products and textures and fabric without falling off and yet be easily removable and restickable to a tally board for keeping track of sales.

6 Claims, 2 Drawing Sheets

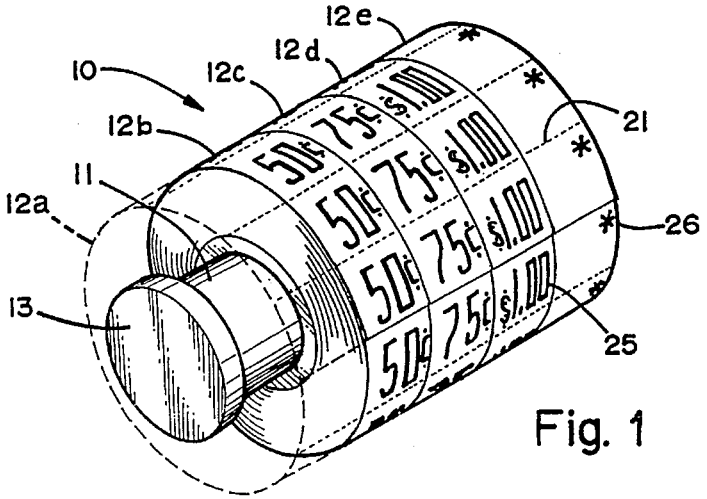
Fig. 1
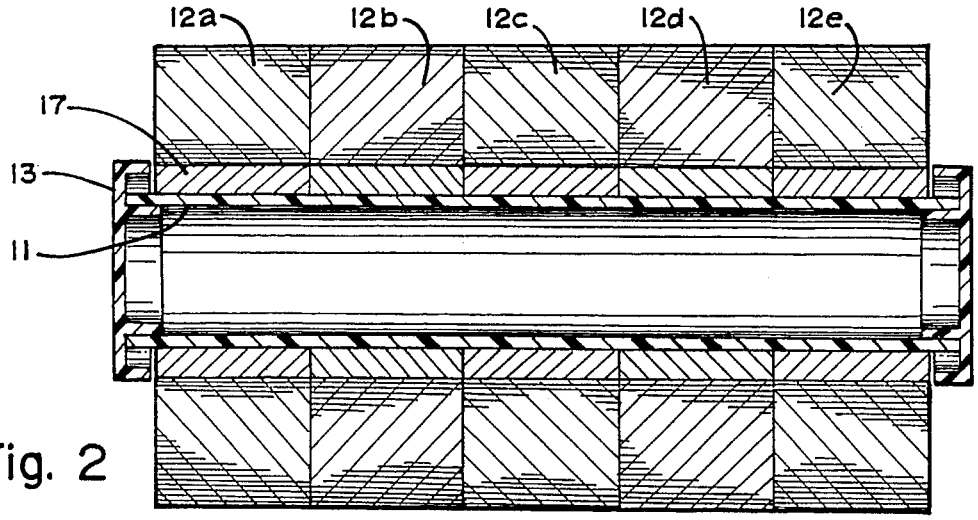
Fig. 2
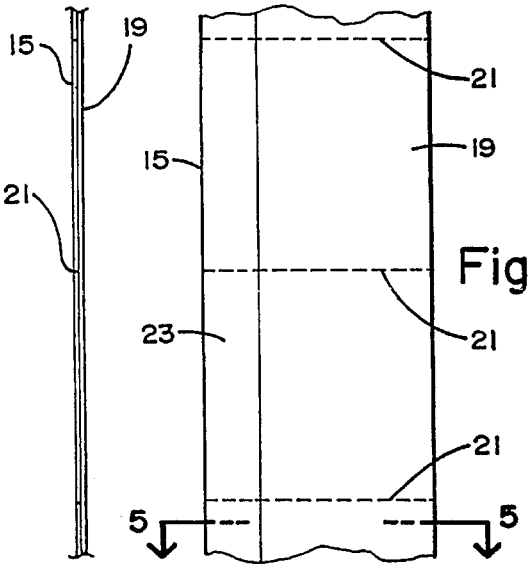
Fig. 3
Fig. 4
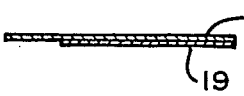
Fig. 5
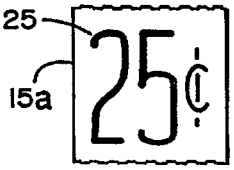
Fig. 6a
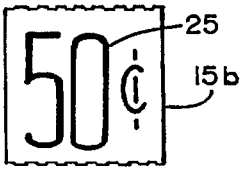
Fig. 6b
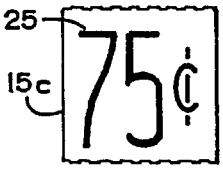
Fig. 6c
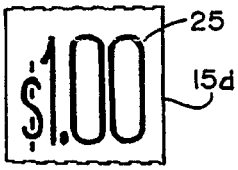
Fig. 6d
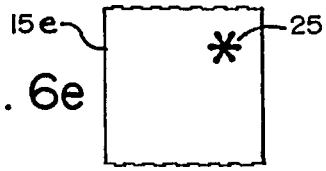
Fig. 6e

GARAGE SALE PRICING LABELS

BACKGROUND OF THE INVENTION

This invention relates to a pricing label and method for efficiently and inexpensively labeling a variety of homogeneous and nonhomogeneous items for a garage sale or the like.

The garage sale phenomenon has become a popular and profitable undertaking across the nation. Families or individuals are able to vend their chattels by placing articles for sale in their house, garage or yard. As used herein the term "garage sale" includes any household sale, including events that may be called estate sales, garage sales, yard sales or moving sales. Occasionally such family sales are combined with other family sales and even businesses. Large events are sometimes referred to as white elephant sales or flea markets. Through these sales systems: (1) families are able to recycle items they no longer use; (2) the usable lifetime of many items is extended; and (3) additional income is available for each participating family. However, one of the most time consuming and tedious aspects of a garage sales is pricing the merchandise, and one of the most complicated parts of a garage sale is accounting for proceeds among different sellers.

Each item to be sold must be marked. This provides convenience for the buyer and relieves the seller from a time consuming recitation of each item's price to the prospective customers. Some sellers write the price directly on the merchandise. This markedly decreases the value of the merchandise and is hence undesirable.

Other sellers affix blank decorative stickers to the merchandise and mark the stickers by hand. These generic stickers either do not readily stick to the wide variety of merchandise available at a garage sale or they stick too hard and cannot easily be removed. Such stickers also may damage the merchandise when the sticker is removed.

The generic stickers currently used are not intended for reaffixation. The sticker usually remains affixed to the merchandise after the sale of the item. A second price recording means, such as a written inventory, must be utilized by the sellers to record the sale and account for any profits. This is time consuming and limits the ability of the sellers to provide adequate customer service. Such recording means are easily susceptible to the adverse affects of wind and precipitation. Additionally, such generic stickers do not readily lend themselves to efficient inventory control in a multi-family garage type sale.

It is an object of the present invention to provide a preprinted pricing sticker which is easily dispensed for indicating pricing information to a potential customer. It is another object of the invention to provide a sticker with a suitable peel strength such that the stickers stick to a wide variety of different products while at the same time are sufficiently easy to remove that fibers or other material from an item are not permanently disfigured upon sticker removal.

It is another object of the invention to provide a simple and efficient marking method for use in a single family or multi-family garage type sale.

SUMMARY OF THE INVENTION

In accordance with the present invention, garage sale pricing labels comprise one or more sets of color coded pricing label strips, each set comprising a plurality of strips of labels. Each strip includes a column of individual labels connected end to end, with transverse perforations extending between the labels for easy separation of the labels by tearing off an end label along the perforations. Each strip is. preprinted with a predetermined price on the labels, with different strips in the set being preprinted with different prices and at least one strip in the set having no price thereon such that the price can be entered by hand. Each set of label strips is color coded with a distinctive color representative of a particular seller. The strips are formed of a tape material wherein a pressure sensitive adhesive is coated on at least a part of one side of a strip of label on which the label information is printed. The characteristics of the adhesive and label material are such that the labels are stickable to a wide variety of products having textured and non-textured wood, glass, plastic and fabric surfaces without falling off but can be removed easily without tearing the label or damaging or removing material from the products. The adhesive also has multiple stick capabilities, such that the labels can be affixed to a tally board for later tabulating sales after they are removed from the products.

The garage sale pricing labels include a plurality of sets of label strips for different sellers in the same sale, with the different sets being color coded with different colors to identify the products of the different sellers who sell products at the same garage sale, each color being assigned to a particular seller.

In one aspect of the invention, the label strips are folded in flat strips and packaged side by side in a clear package that displays the preprinted information on each strip through the package. Desirably each set comprises separate strips for each of at least four preprinted prices plus a strip containing no preprinted price.

In one embodiment of the invention, the strips are formed of a printable flat back paper tape having release paper on the adhesive material. The release paper for each label has a cut through only the release paper so as to divide the label into major and minor portions behind the release paper, the release paper behind the major portion is removable to affix the label on the product, the release paper on the minor portion serving to prevent the minor portion from sticking to the product so that the minor portion can serve as an easy-to-grip tab for application and removal of the labels. Desirably, the cut in the release paper is formed longitudinally along an edge of the strip such that the edge forms the minor portion of each label.

In another aspect of the invention, the label strips are rolled in rolls, one roll for each preprinted price, the rolls of each set being mountable on a common rod that extend axially through an open axial core of each roll, such that the labels for each set can be dispensed side by side from a common rod.

In another embodiment of the labels, a minor portion of each label along a longitudinal edge of the strip is not coated with adhesive and serves as a grippable tab for applying and removing the labels.

The labels of the present invention are formed of printable flat back paper tape wherein the bonding strength of the label to the adhesive exceeds the bonding strength of the adhesive to the item The item may be wood, metal, glass, plastic or fabric. The tear strength of the label is greater than the peel strength of the label from the item. The bonding strength is sufficiently low such that an item's finish is not damaged or visibly impaired by removal. The residual bonding strength of the adhesive after removal from the item is strong enough to permit reaffixation to a second surface.

The pricing labels are affixed to products for a garage sale. When the products are sold, the labels are removed and affixed (i.e. stuck) to a tally board. The label prices are later tabulated by color for each seller to determine the manner in which sale proceeds are to be divided.

BRIEF DESCRIPTION OF THE DRAWINGS

FIG. 1 is a perspective view of the invention configured as rolls of sticker tabs mounted on a tape roll dispenser.

FIG. 2 is a cross sectional view showing the rolls of sticker tabs supported on the tape roll dispenser.

FIG. 3 is a rear view showing a single strip of a first embodiment of perforated pricing sticker tabs.

FIG. 4 is an edge view of the single strip of perforated pricing sticker tabs of FIG. 3.

FIG. 5 is a sectional view taken along line 5—5 of FIG. 3.

FIGS. 6*a*—6*e* are front views of individual pricing sticker tabs showing pricing information.

DETAILED DESCRIPTION OF THE PREFERRED EMBODIMENT

Figure 7:
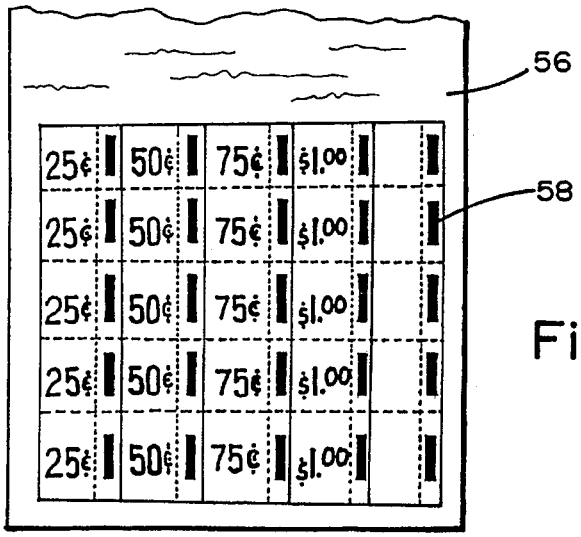
FIG. 7 is a front elevational view of a clear package containing a set of folded pricing strips in accordance with the present invention.

Referring to the drawings and more particularly to FIG. 1. a pressure sensitive adhesive pricing sticker system 10 is disclosed for efficiently and inexpensively dispensing a plurality of pricing stickers. Individual tape roll stickers 15, such as stickers 15*a*, 15*b*, 15*c*, 15*d*, and 15*e* are formed as transversely perforated strips. Said strips are then wrapped into rolls such as roll 12*a*, 12*b*, 12*c*, 12*d* and 12*e*. The strips may be partially or completely covered with a release paper (not shown in FIGS. 1–5) of the same type as backing paper 46 of FIGS. 8, 9, and 12.

A tape roll dispenser is indicated by a combination of dispensing core 11 and end cap 13. Each of the rolls are mounted on dispensing core 11. The rolls are relatively lightweight and are allowed to rotate on the dispensing core. End caps 13 on each end of the core hold the rolls on dispensing core 11. One or both of the end caps may be removable to allow the addition of more tape rolls onto the dispensing core. Each strip of pricing stickers is perforated along transverse perforations 21 to facilitate removal of each sticker from the strip. The user Grasps a free end of a tape roll and removes an individual sticker by tearing along perforation 21.

Preferably, fixed rolls of stickers with different prices are used to provide a variety of pricing information. Four of the rolls of pricing stickers contain a predetermined price. A combination of 25 cents, 50 cents, 75 cents, and $100 stickers offers a variety of commonly used prices at garage sales. A fifth tape roll contains a blank portion for the seller to write in the desired price himself. The fifth roll of tape is preprinted with an asterisk to alert a potential customer to the nonstandard price.

In reference to FIG. 2, the interior of the tape roll dispenser is displayed. In this embodiment, the dispenser contains two end caps 13 to secure the rolls of tape 12*a*–*e* in place. The individual tape roll stickers are wrapped around wrapping tube 17. Wrapping tube 17 then fits slidably over dispensing core 11.

FIG. 3 shows a rear view of the individual tape roll stickers along a single strip. Non-perforated tape may be tape such as 3M proprietary Highland Taper High Performance Packaging Tape #3501 Core Series 5-4200 (#17), or 2301 core (#17). However, perforated tape producing a sticker 15 measuring 25.4 mm×25.4 mm provides the optimum combination of visibility, ease of removal, and cost conservation.

The sticker in FIGS. 3–5 is only coated with a pressure sensitive adhesive on a portion of sticker 15 as indicated by partial adhesive section 19. This adhesive desirably is a hot melt synthetic rubber pressure sensitive adhesive 0.8 to 1.2 mils thick. Nonadhesive section 23 is void of any adhesive. This section 23 extends 6.35 mm toward the center of the sticker. The perforation 21 is 25.4 mm in spacing along the individual rolls of tape. An appropriate adhesive tape has the characteristics of Scotch Painter's glue tape 2050, which has a peel strength of 26 oz/in and a tensile strength of 20 oz/in. The tape thickness is 5.3 mil and may be stretched 7% before breakage.

FIGS. 4 and 5 correspond to FIG. 3 to show an edge view and a sectional view respectively. In FIGS. 4 and 5 partial adhesive section 19 has been exaggerated in thickness to show its relative position on the sticker. Although not shown in these figures, the stickers may be dispensed with a release paper backing which prevents the adhesive from sticking to other surfaces during transport. The sticker would then be peeled from this release paper backing before affixation to an item.

FIGS. 6*a*–6*e* show pricing information 25 on individual tape roll stickers. The pricing information in FIGS. 6*a*–6*d* is 25 cents, 50 cents, 75 cents and $1.00 respectively. In FIG. 6e the pricing information is an asterisk which signals to a potential purchaser that a nonconventional price is being charged. The tape can be written upon for entry of an individual price.

Figure 12:
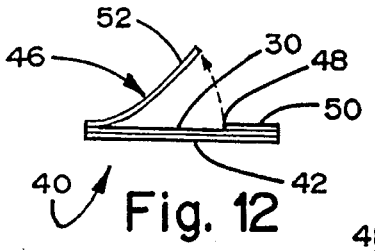
FIG. 12 is a sectional view taken along line 12—12 of FIG. 9.
Figure 8:
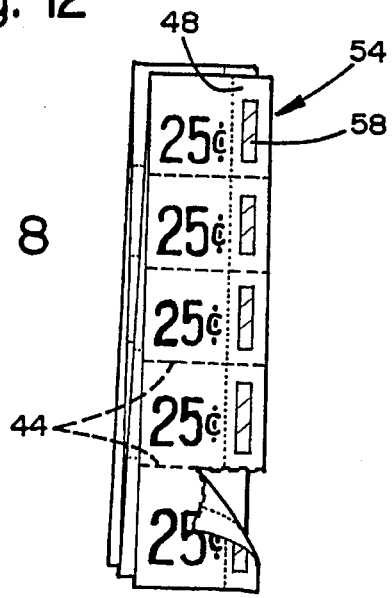
FIG. 8 is a perspective view of a folded strip of a second embodiment of pricing labels of the present invention, showing one of the labels being torn from the strip along the perforations.
Figure 9:
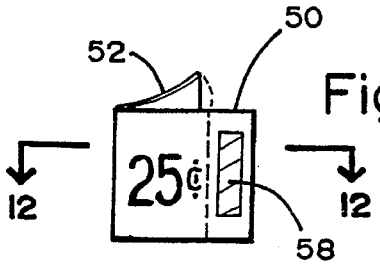
FIG. 9 is a perspective view of one of the labels of the FIG. 8 strip, showing the release paper being removed from the label, leaving a portion of the release paper on the hand held tab.
Figure 10:
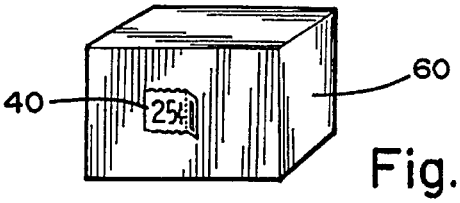
FIG. 10 is a perspective view showing a label of the present invention affixed to a product.
Figure 11:
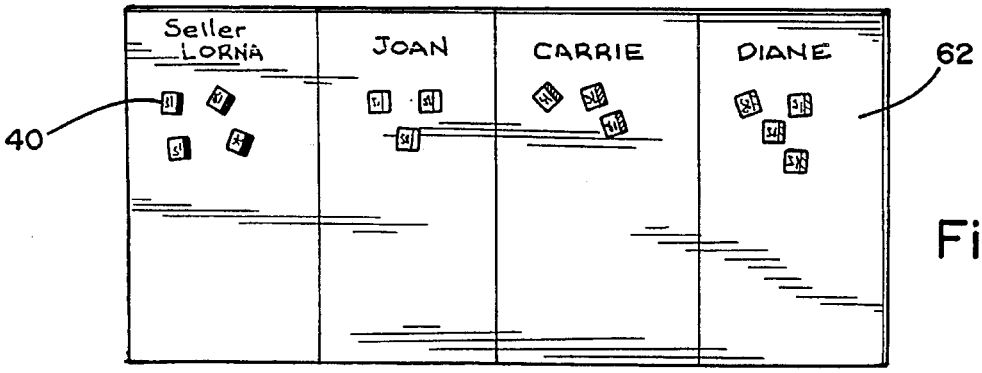
FIG. 11 is a view of a tally board showing the affixation of pricing labels thereto after they are removed from products that are sold.

In an alternate embodiment 40 of the pricing label, as shown by FIGS. 7–10 and 12, the adhesive section covers the entire back of the label material 42 as indicated by full adhesive layer 30. The pricing sticker 40 is still torn along perforations 44. However, in this case, the label is covered completely by release paper backing 46, which is cut longitudinally along line 48 to form disposable backing piece 52, major portion of the label and nondisposable backing piece 50. That covers a minor portion of the label; An non-adhesive section comparable to section 23 of FIG. 3 is formed by retaining nondisposable backing piece 50 on the label 40, as shown in FIGS. 9 and 12. Disposable backing piece 52 is removed to allow the portion of adhesive layer 30 under a backing piece 52 to contact an item 60, as shown in FIG. 10. This embodiment is more economical to manufacture since the technology involved with cutting a backing piece is much simpler than positioning an adhesive on only a portion of a sticker.

In FIGS. 7–12, the pricing labels are not packaged in rolls but are packaged in folded strips 54, as shown in FIG. 8. These strips are placed side by side in a clear package 56, as shown in FIG. 7 for packaging and display.

Each of the pricing labels, whether of the type packaged in rolls or the type packaged flat in folded strips is color coded to reflect a particular seller. The color coding can be incorporated into the printed prices themselves but can also be incorporated into a color strip 58 positioned along one edged such as the tab edge of the pricing label. The color strips make the color of the labels stand out more effectively.

In a pricing system in which the invention is used, a seller tears off individually pricing stickers from a roll or strip of tape. The seller then affixes the pricing sticker with partial adhesive section 19 or full adhesive section 30 to an item to be sold. If the item requires an unusual price, the price is written on a blank sticker such as FIG. 6e and then affixed to the item. When a sale is made, the purchaser presents the item with appropriate sticker to the seller for payment. The seller then removes the sticker and reaffixes it to an inventory or tally board 62 (FIG. 11) to record the purchase. The inventory board could also be a notebook, piece of cardboard or simply the table where the change box is located. At the end of a business day, the stickers are tallied.

This system easily lends itself for use in a multi-family garage type sale. In such a sale, each family has its own set of pricing label strips, with each family's set being a separate color, such as red, pink, turquoise, green, black, and purple. When a purchaser presents an item for tender, the color coded sticker is removed and the cash is deposited in a group cash box. The sticker is then affixed to the inventory board 62 along with the other stickers of the same color for each seller. At the end of the business day, each color group on the inventory board is tallied and a subtotal is determined. Each family's prorata share out of the group cash box is then equal to it's color coded subtotal. The blank labels allow room for a nonconventional price to be written. Thus the pricing sticker may be color sorted according to the color of the label and appropriately placed on the inventory board for a group sale.

A preferred tape used in the second embodiment of the invention is called printable flat back paper tape. The tape is about eight mils thick and the adhesive (a hot melt rubber is satisfactory) is about 0.8 to 1.2 mils thick and usually about 0.8 to 1.0 mils thick. The liner or release paper is about two mils thick. The adhesive characteristics are similar to the tape described previously.

It should be understood that the foregoing is merely exemplary of the preferred practice of the present invention and that various changes may be made in the arrangements and details of construction of the embodiments disclosed herein without departing from the spirit and scope of the present invention, which is defined in the appended claims.

I claim:

1. Garage sale pricing labels for removably affixing price and selling information on products being sold, comprising at least one set of color coded pricing label strips, the set comprising a plurality of strips of labels, each strip including a column of individual labels connected end to end, with transverse perforations extending between the labels for easy separation of the labels by tearing off an end label along the perforations, different strips in the set being preprinted with different prices and at least one strip in the set having no price thereon such that the price can be entered by hand, the set of label strips being color coded with a distinctive color representative of a particular seller, the strips being formed of a tape material wherein a pressure sensitive adhesive material is coated on one side of a strip of label material, the characteristics of the adhesive material and label material being such that the labels will stick to a wide variety of products having textured and non-textured wood, glass, plastic and fabric surfaces without falling off but can be removed easily from the products without tearing the label or damaging the products, the adhesive material having multiple stick capabilities such that the labels can be affixed to a tally board for later tabulating sales after they are removed from the products, the label material of the strips being formed of a printable flat back paper tape, the adhesive material coating the entire surface of the tape, a release paper backing covering the adhesive material, the release paper for each label having a cut that extends through only the release paper so as to divide the label into major and minor portions behind the release paper, the release paper behind the major portion being removable to affix the label on the product, the release paper on the minor portion serving to prevent the minor portion from sticking to the product so that the minor portion can serve as an easy-to-grip tab for application and removal of the labels, the cut in the release paper being formed adjacent to and parallel to an edge of the strip such that the portion of the strip adjacent that edge forms the minor portion of each label.

2. Garage sale pricing labels according to claim 1 and further comprising a plurality of sets of label strips, with the sets being color coded with a plurality of different colors so as to identify the products of different sellers who sell products at the same garage sale when each color is assigned to a particular seller.

3. Garage sale pricing labels according to claim 1 wherein each set comprises separate strips for each of at least four preprinted prices plus a strip containing no preprinted price.

4. Garage sale pricing labels according to claim 1, wherein the characteristics of the label backing material and adhesive material are as follows:

the bonding strength of the adhesive material to the label backing material exceeds the bonding strength of the adhesive material to wood, metal, glass, plastic or fabric products;

the tear strength of the label backing material is greater than the peel strength of the label from wood, metal, glass, plastic or fabric products;

the bonding strength of the adhesive material is low enough that the surface of a wood, metal, glass, plastic and fabric product to which the label is applied is not damaged or visibly impaired by label removal therefrom; and the adhesive material retains residual bonding strength after removal of each label from a wood, metal, glass, plastic or fabric product to permit the label to be reaffixed to a second surface.

5. A label according to claim 4, wherein the adhesive is a material having bonding characteristics substantially the same as adhesives used for masking tape.

6. A label according to claim 4, wherein the adhesive comprises a hot melt synthetic rubber pressure sensitive adhesive.

* * * * *